United States Patent [19]

Volland

[11] 4,227,554

[45] Oct. 14, 1980

[54] DEVICE FOR REGULATING THE WINDING TENSION OF WOVEN FABRIC ON A LOOM

[75] Inventor: Michel F. Volland, Bourgoin-Jallieu, France

[73] Assignee: Saurer-Diederichs Société Anonyme, Bourgoin-Jallieu, France

[21] Appl. No.: 29,480

[22] Filed: Apr. 12, 1979

[30] Foreign Application Priority Data

Jun. 7, 1978 [FR] France ..... 78 17704

[51] Int. Cl.[2] ..... D03D 49/20

[52] U.S. Cl. ..... 139/310; 139/108; 242/67.5; 242/75.5

[58] Field of Search ..... 139/108, 304, 307, 308, 139/310, 311; 242/45, 67.5, 75.5, 75.45

[56] References Cited

U.S. PATENT DOCUMENTS

| | | | |
|---|---|---|---|
| 3,620,262 | 11/1971 | Atkinson | 139/310 |
| 3,669,376 | 6/1972 | Lucas | 242/75.45 |
| 3,727,856 | 4/1973 | Kitch | 242/67.5 |
| 3,762,662 | 10/1973 | Owens | 139/304 |
| 4,008,114 | 2/1977 | Lindsey | 242/75.45 |

*Primary Examiner*—Henry Jaudon
*Attorney, Agent, or Firm*—Karl F. Ross

[57] ABSTRACT

A loom has a winding system comprising a tension roller and a storage roller connected by means of an endless chain whereby the storage roller is driven by the tension roller with the interposition of a friction mechanism.

A follower roller, in contact with the periphery of the roll of fabric wound around the storage roller, causes a rotary cam to rotate such that the movement of the latter is linked with the variation in diameter of the roll of fabric. Bearing against the profile of the cam is one end of an oscillating lever, the other end of which acts on the friction mechanism in order to modify the driving torque of the storage roller by the chain according to the diameter of the roll of fabric.

The fabric tension regulating device can be applied to conventional looms and shuttleless looms.

10 Claims, 7 Drawing Figures

DEVICE FOR REGULATING THE WINDING TENSION OF WOVEN FABRIC ON A LOOM

The present invention relates to a device for regulating the winding tension of woven fabric on a loom, in which the winding system comprises a tension roller and a storage roller connected by means of an endless chain, whereby the storage roller is driven by a tension roller with the interposition of a friction mechanism.

In a loom equipped with such a winding system the driving torque of the storage roller remains substantially constant, the friction mechanism operating as a torque-limiting device. It will be understood that this makes it impossible to obtain a constant tension throughout the operation of winding the woven fabric, during which the diameter of the roll of woven fabric wound around the storage roller changes from a value, say, of the order of 100 mm to a value, say, of the order of 600 mm for example.

It has already been proposed to provide a regulating device which allows, according to the increase in the diameter of the roll of fabric, the driving torque of the storage roller to be modified automatically. However, no acceptable industrial solution has been developed hitherto from this proposal (compare published French Pat. Application No. 2,289,652).

The present invention provides a mechanical solution which is easy to produce, for looms of the above-mentioned type, without requiring considerable modifications to the winding system.

According to the present invention there is provided a device for regulating the winding tension of woven fabric on a loom, in which the winding system comprises a tension roller and a storage roller connected by an endless chain, whereby the storage roller is driven from the tension roller, the device comprising a follower for contacting the periphery of a roll of fabric wound around the storage roller, a rotary cam movable with the follower according to variation in the diameter of the roll of fabric, and an oscillating lever, whereof one end bears against the cam profile and the other end acts on a friction mechanism coaxial with the tension roller so as to modify the driving torque of the storage roller according to the diameter of the roll of fabric.

As the roll of fabric increases, this kinematic principle makes it possible to pivot a lever by actuating the latter by means of a cam having a suitably chosen profile, in order to increase the driving torque progressively and thus to obtain substantially constant tension.

The follower is preferably in the form of a roller, the ends of which are connected to two levers mounted to rotate about an axis parallel to the axes of the tension roller and storage roller, the cam being rotatable with the two levers. The two levers are located at the two sides of the loom and the cam may be directly connected to rotate with these two levers.

Preferably, the circumference of the cam profile is divided into two identical parts, each corresponding to an arc of 180°, the oscillating lever bearing against the cam profile, at two diametrically opposed areas, through the intermediary of two coaxial rollers. This oscillating lever may act on the friction mechanism through the intermediary of two other coaxial rollers, said mechanism comprising a sliding control ring comprising an annular face on which these rollers are applied.

The oscillating lever advantageously has a "double fork" or "H" shape, with two parallel arms interconnected by a hollow central part, the four rollers being supported by the ends of these two arms.

The friction mechanism preferably comprises a sleeve connected to rotate with the shaft of the tension roller, a circular plate integral with the sleeve, a movable circular plate surrounding the sleeve and rotatable with the latter, spring washers located between the movable plate and the sliding control ring, which is rotatable with the sleeve, and a toothed wheel for driving the chain located between the two said circular plates with the interposition of packings. As the roll of fabric enlarges, the lever acts by moving the sliding control ring axially, thus progressively compressing the spring washers in order to increase the driving torque of the chain. The control ring advantageously comprises an external screw thread, onto which is screwed a position-adjustable nut against which one of the spring washers bears, which also allows initial manual adjustment.

The oscillating lever is preferably pivotally mounted in its central region on an elongated member, whereof one end is connected to the shaft of the tension roller and the other end is connected to the shaft integral with the two levers supporting the follower roller. The entire regulating device is thus "suspended" between the ends of the two shafts and no special support is thus required for attachment to the frame of the loom.

The oscillating assembly of the lever may be provided by a mechanism comprising an eccentric controlled by a release handle and, in one position, making it possible to push the ends of the lever towards the cam and the friction mechanism, and, in another position, to move the lever away from the cam and friction mechanism, in order to put the regulating device out of operation.

An embodiment of the present invention will now be described, by way of example, with reference to the accompanying drawings, in which.

Figure 1:
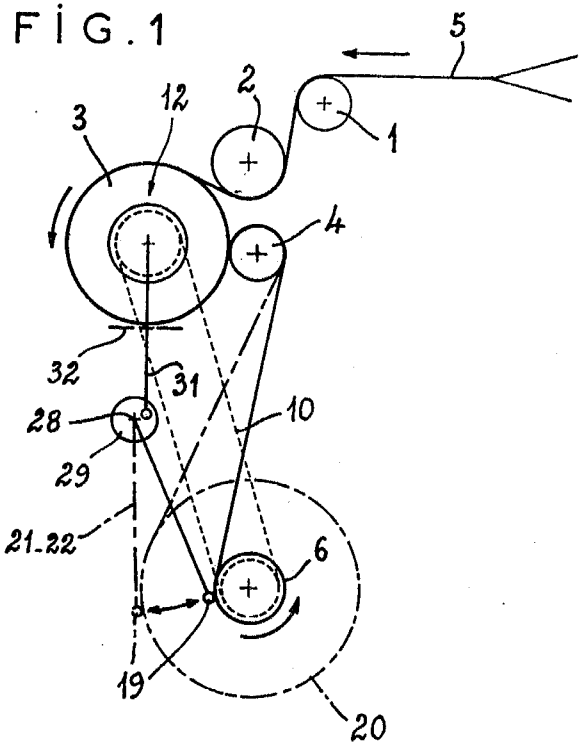
FIG. 1 is a simplified diagram of the device for regulating the winding tension of woven fabric on a loom.
Figure 2:
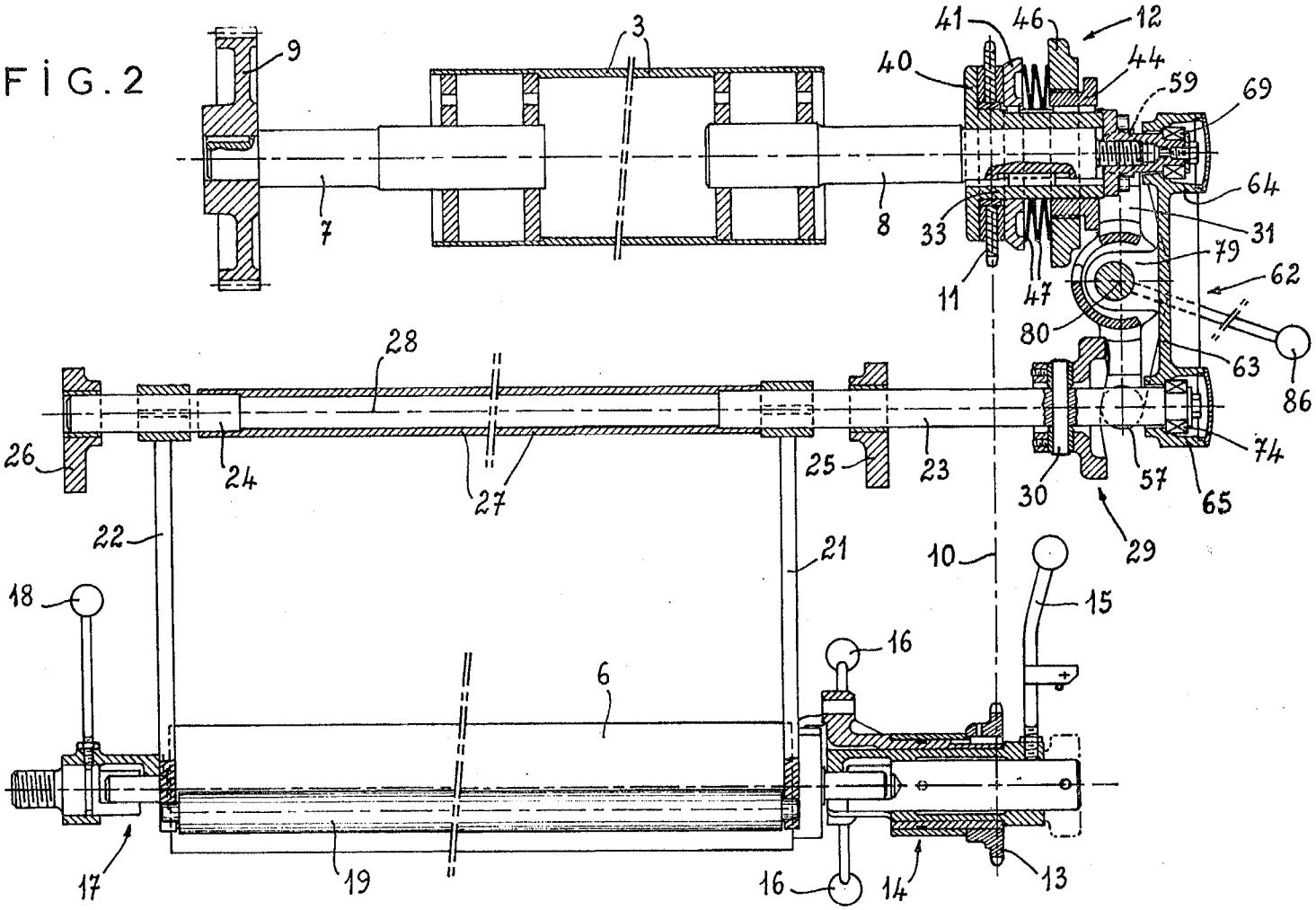
FIG. 2 is a part-sectional front view of the device.

The principle of the device according to the invention and its arrangement with respect to conventional components of the loom, are illustrated in FIG. 1, which shows a fixed breast-beam 1, a guide roller 2, a tension roller 3 and a pressure roller 4, over which woven fabric 5 passes in succession before being wound around a storage roller 6. In known manner and as shown in FIG. 2, the tension roller 3, mounted on two half shafts 7 and 8 is rotatable by a pinion 9 keyed on the half shaft 7, the tension roller 3 rotating the storage roller 6 by means of an endless chain 10. The latter passes around a chain wheel 11 supported on the half shaft 8 and connected thereto by means of a friction mechanism 12 and also around a chain wheel 13 rotating with the storage roller 6.

The chain wheel 13 is, as a rule, connected to rotate with the storage roller 6 but it should be noted that a driving and unlocking device 14 is provided at the end of the roller 6 adjacent the chain 10, which device 14 is provided with an unlocking handle 15 and with handles 16 to permit manual drive of the roller 6. A simple unlocking device 17 provided with an unlocking handle 18 is provided at the other end of the roller 6.

The tension-regulating device comprises a follower roller 19, the axis of which is parallel to that of the storage roller 6 and which bears against the periphery of a roll of fabric 20 wound, at any given instant, around said storage roller 6. The ends of the follower roller 19 are connected to the ends of two levers 21 and 22, keyed on two coaxial shafts 23 and 24 respectively, which rotate in fixed supports 25 and 26 and are connected for simultaneous rotation by means of a tube 27. The assembly formed by the follower roller 19, the levers 21 and 22, the shafts 23 and 24 and their connecting tube 27 may thus rotate about a horizontal axis 28 parallel to the axes of the various rollers of the winding system.

Figure 7:
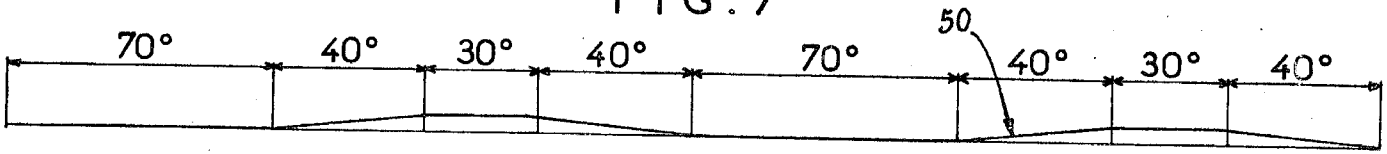
FIG. 7 is a development of the profile of the cam.
Figure 3:
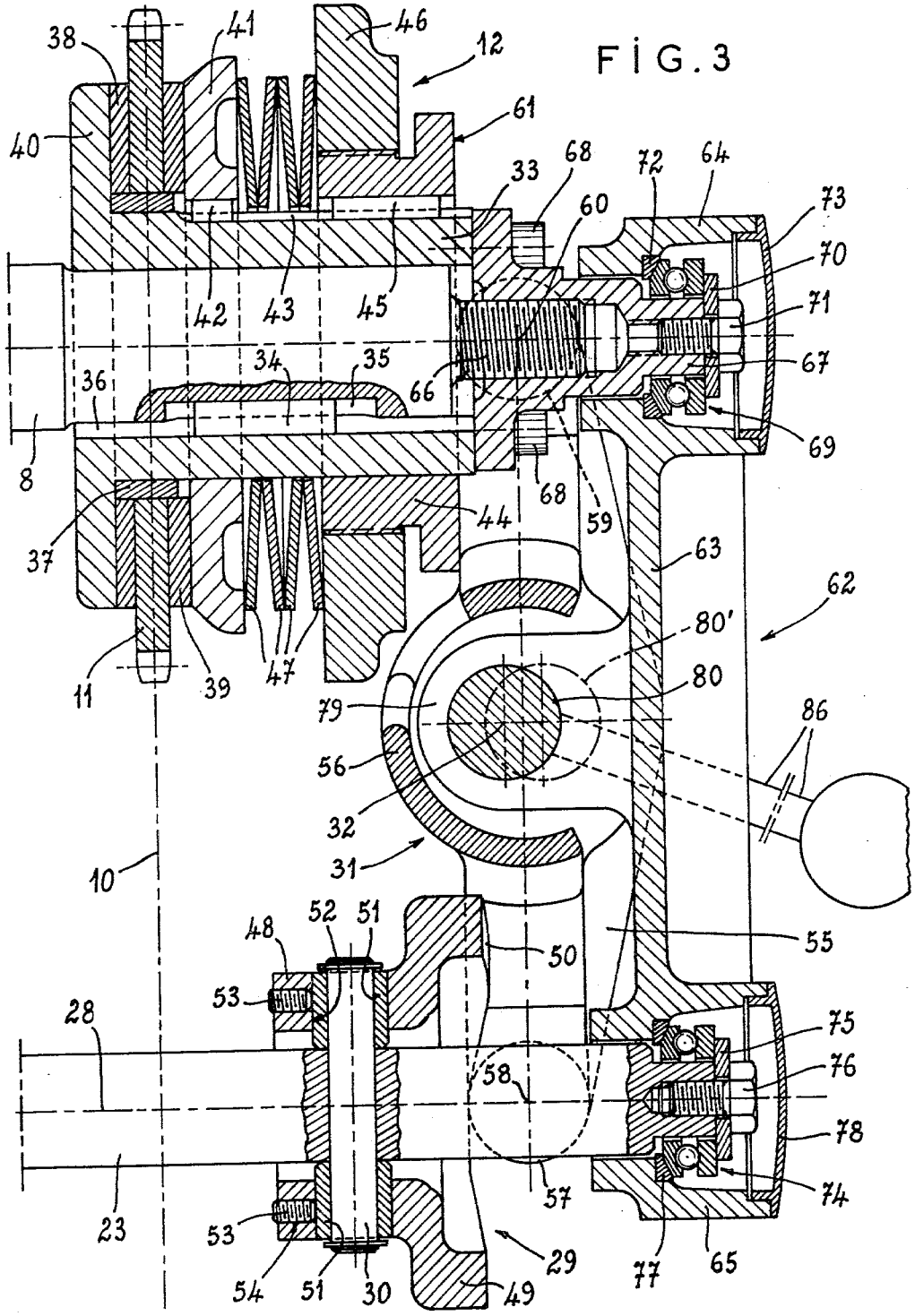
FIG. 3 is a fragmentary view, to an enlarged scale, showing a detail of FIG. 2.

The shaft 23 located adjacent the chain 10 rotatably supports a cam 29 able to oscillate about a spindle 30 at right-angles to the axis 28. This cam 29 actuates a lever 31 which can oscillate about a pivot 32 at right-angles to the axis of rotation 28 of the cam. The lever 31 acts on the friction mechanism 12. FIGS. 1 and 2 illustrate the kinematic principle of the device clearly, whereas FIGS. 3 to 7 show details of the construction, which are described hereafter:

The friction mechanism 12, shown in FIG. 3, comprises a sleeve 33 surrounding the end of the half shaft 8 and connected to rotate with the latter by a key or cotter 34, housed in respective grooves 35 and 36 in the half shaft 8 and in the sleeve 33. The chain wheel 11 is in the form of a ring comprising external toothing, mounted about a ring 37 which surrounds the sleeve 33 and clamped between two packings 38 and 39. The packing 38, located adjacent the tension roller 3 is pressed against a circular plate 40 integral with the sleeve 33. The other packing 39 is pressed against a movable circular plate 41, surrounding the sleeve 33 and connected to rotate with the latter by a key or cotter 42, engaged in a groove 43 in the sleeve. The sleeve 33 is also surrounded, on the opposite side to the tension roller 3, by a sliding control ring 44, itself connected to rotate with the sleeve by a key or cotter 45 engaged in the groove 43. The ring 44 comprises an external screw thread onto which is screwed a nut 46 located opposite the movable plate 41. Several spring washers 47 are located around the sleeve 33, compressed between the movable plate 41 and the nut 46. The cam 29, illustrated separately in FIG. 6, comprises a cylindrical part 48 through which the shaft 23 passes and a part 49 of larger diameter in the form of a ring, on which is formed the cam profile 50, directed outwardly of the machine. The oscillation spindle 30 rotates with respect to the cam in two rings 51, mounted in bores 52 in the part 48 and which are immobilised by locking screws 53 in tapped holes 54 opening into the bores 52 (see FIGS. 3 and 6). The development of the cam profile 50 is shown in FIG. 7. As shown in this Figure, the complete circumference (360°) of the profile is divided into two identical parts, each corresponding to an arc of 180°, with an ascending slope and a descending slope connected by straight portions, the arcs of circles corresponding to these parts having the values indicated by way of example on the drawing.

Figure 4:
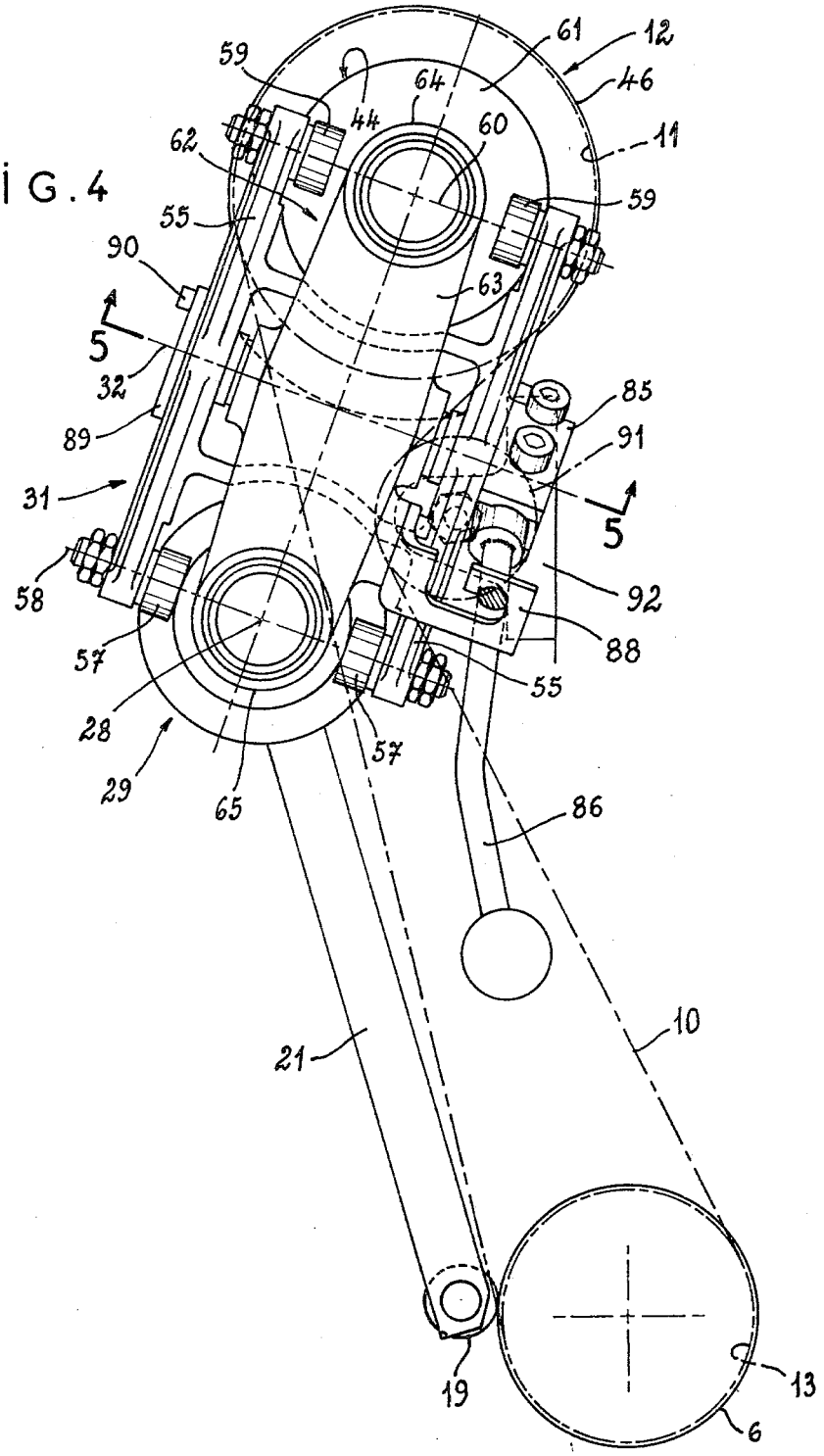
FIG. 4 is a side view of the device.

The lever 31 has a "double fork" or "H" shape, as shown in FIG. 4, with two parallel arms 55 interconnected by a hollow central part 56, which defines a recess of general cylindrical shape. The lower ends of the two arms 55 each support a roller 57 rotating freely about a common axis 58 parallel to the oscillation axis 32 of the lever. The spacing of these two rollers 57 and their position are such that they can roll on the cam profile 50, bearing against two diametrically opposed areas of this profile, which are at the same "height", taking into account the division of the profile into two identical parts each corresponding to an arc of 180°. In a symmetrical manner, the upper ends of the two arms 55 also each support a roller 59 rotating freely about a common axis 60 parallel to the oscillation axis 32 of the lever. The position of these two other rollers 59 is such that they bear against and roll on the exposed annular face 61 of the sliding control ring 44.

In its central region, the lever 31 is mounted to oscillate on a support member in the form of an annulus 62, formed by an elongated part 63 connecting two annular ends 64 and 65 which are connected respectively to the half shaft 8 and to the shaft 23. At its end, the half shaft 8 comprises a screwthreaded head 66 on which is screwed an extension 67, also connected to the sleeve 33 by screws 68. A thrust ball bearing 69 is mounted between a washer 70, fixed by a screw 71 to the end of the extension 67 and a ring 72 housed in the upper annular end 64 of the member 62, this annular part being closed-off on the outer side by a cover 73. In a substantially similar manner, another ball bearing 74 is mounted at the end of the shaft 23, between a washer 75 fixed by a screw 76 to this end and a ring 77 housed in the lower annular end 65 of the member 62, this annular part being closed-off on the outer side by a cover 78 (see FIG. 3).

Figure 5:
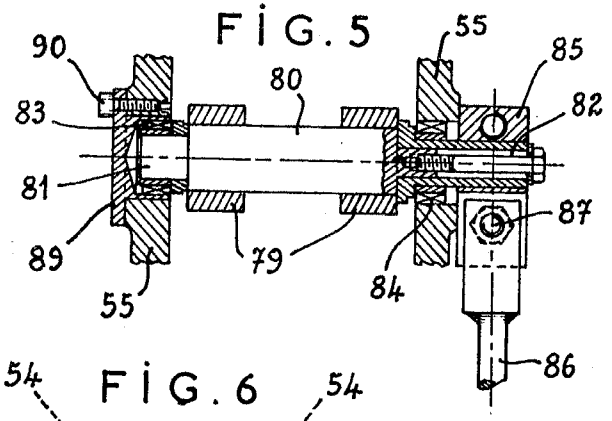
FIG. 5 is a sectional view, on the line 5—5 of FIG. 4, showing the mechanism comprising the eccentric.
Figure 6:
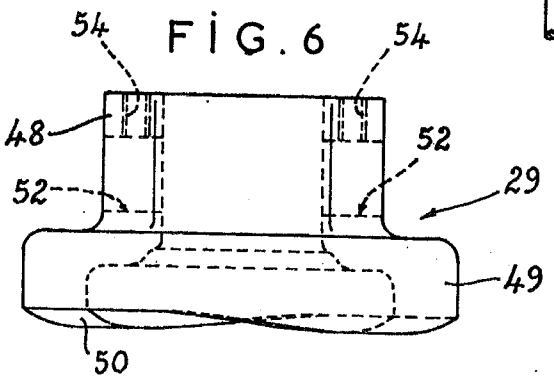
FIG. 6 is a side view of the cam of the device.

Formed in the central region of the annular member 62 are two lugs 79, projecting from the elongated part 63 and constituting a yoke through which a shaft 80 passes, which extends in the recess of the central part 56 of the lever 31. As shown in FIG. 5, at its ends, the shaft 80 has two extensions 81 and 82 of unequal length, surrounded by rings, these extensions both being identically eccentric with respect to the shaft 80. The lever 31 pivots, by means of its two arms 55, about eccentric extensions 81 and 82 respectively, needle bearings 83 and 84 being provided for this purpose. Locked on the longer extension 82 is a yoke 85 supporting a release handle 86, which can rotate with respect to the yoke 85 about a pivot 87. The stem of the handle 86 is normally retained in a catch 88 integral with the annular member 62 (see FIG. 4). On the opposite side to the handle 86, the shoter extension 81 of the shaft 80 does not rotate directly in the arm 55, but in an attached member 89, mounted in a recess in this arm and connected to the latter by a screw 90, this arrangement being necessary to facilitate mounting of this mechanism comprising an eccentric.

It will be noted that the entire device is supported by the various shafts and is not fixed directly to the frame of the machine. Only one roller 91 serving as means for tensioning the chain 10 is mounted on a support 92 fixed to the frame, as shown in FIG. 4.

The normal operation of the device according to the invention is as follows:

As the fabric 5 winds around the storage roller 6, the follower roller 19 is moved in accordance with the variation in diameter of the roll of Fabric 20 and the levers 21 and 22 pivot about the axis 28, thus causing the shaft 23 to rotate with the cam 29. The position of this cam is such that the two lower rollers 57 of the lever 31 thus roll on two diametrically opposed ascending slopes of the cam profile 50, in order to bring about a pivotal movement of the lever 31 about the axis 32, a pivotal movement which takes place in counter-clockwise direction in the case of FIGS. 2 and 3. The two upper rollers 59 of the lever 31, bearing against the annular face 61 of the sliding ring 44, move this ring with respect to the sleeve 33, towards the tension roller 3. The nut 46 is thus moved progressively towards the movable plate 41 and as the compression of the spring washers 47 increases, the tension of the chain wheel 11 becomes increasingly greater as the driving torque of the storage roller 6 increases. It is thus possible to obtain uniform tension of the fabric, despite the variation in diameter of the roll of fabric 20.

The oscillatory mounting of the cam 29 on the shaft 23, by means of the spindle 30, enables the other rollers 57 and 59 to bear permanently against the can profile 50 and the face 61 of the ring 44, whatever the twisting forces to which the device may be subjected.

Furthermore, the nut 46 mounted on the sliding ring 44 allows an initial adjustment of the pressure exerted on the spring washer 47.

The mechanism comprising an eccentric, controlled by the handle 86, makes it possible to place the shaft 80 either in the hatched position, or in the position 80' drawn in dot-dash lines, in FIG. 3, with respect to the pivot 32 about which the lever 31 is able to oscillate. In one of these positions, corresponding to the locked position of the handle 86, the lever 31 is pushed towards the cam 49 and the friction mechanism 12, which allows the abovedescribed so-called normal operation. In the other position, the lever 31 is moved away from the cam 29 and the mechanism 12, so that in the latter, the spring washers 47 are no longer compressed. The device is thus "released" and out of operation, the chain wheel 11 is able to rotate freely and it is thus possible to drive the storage roller 6 manually, by means of the handles 16.

The device for regulating the winding rension of woven fabric according to the invention can be applied to looms of all types, both conventional looms as well as shuttleless looms.

What is claimed is:

1. A device for regulating the winding tension of woven fabric on a loom having a winding system comprising a driven tension roller, a storage roller spaced from and parallel with the tension roller and an endless chain connecting the rollers whereby the storage roller is driven by the tension roller, the device comprising a follower for contacting a roll of fabric wound around the storage roller, a rotary cam operatively associated with the follower so as to be movable therewith in accordance with variation in the diameter of the roll of fabric, a friction mechanism coaxial and rotatable with the tension roller, an oscillating lever bearing at opposed ends on the friction member and the profile of the cam whereby the driving torque of the storage roller is modified according to the diameter of the roll of fabric.

2. A device according to claim 1, in which the circumference of the cam profile is divided into two identical parts each corresponding to an arc of 180°, the oscillating lever bearing against the cam profile at two diametrically opposed areas through the intermediary two coaxial rollers.

3. A device according to claim 2, in which the oscillating lever acts on the friction mechanism through the intermediary of two other coaxial rollers, said mechanism comprising a sliding control ring having an annular face against which these other rollers bear.

4. A device according to claim 3, in which the oscillating lever has a "double fork" or "H" shape, constituted by two parallel arms interconnected by a central hollow part, the four rollers being supported by the ends of these two arms.

5. A device according to claim 3, in which the friction mechanism comprises a sleeve connected to rotate with the shaft of the tension roller, a circular plate integral with the sleeve, a movable circular plate surrounding the sleeve and rotatable with the latter, spring washers located between the movable plate and the sliding control ring which is also rotatable with the sleeve, and a toothed wheel for driving the chain and located between the two said circular plates with the interposition of packings.

6. A device according to claim 5, in which the sliding control ring of the friction mechanism comprises an external screw thread on which is screwed a position-adjustable nut against which one of the spring washers bears.

7. A device according to claim 1, in which the follower is in the form of a roller, the ends of which are connected to two levers rotatable about an axis parallel to the axes of the tension roller and of the storage roller, the cam being connected to rotate with the two said levers.

8. A device according to claim 7, in which the cam is connected to a shaft integral with the two levers supporting the follower roller by means of a pivot pin normal to the axis of rotation of said levers.

9. A device according to claim 8, in which the oscillating lever is pivotally mounted, in its central region, on an extended member, one end of which is connected to the shaft of the tension roller and the other end of which is connected to the shaft integral with the two levers supporting the follower roller.

10. A device according to claim 9, in which the pivotal mounting of the lever on the extended member is achieved by means of a mechanism comprising an eccentric controlled by a release handle and, in one position, making it possible to push the ends of the lever towards the cam and the friction mechanism and, in another position, to move the lever away from the cam and the friction mechanism in order to put the regulating device out of operation.

* * * * *